US005215543A

United States Patent [19]

Milora et al.

[11] Patent Number: 5,215,543

[45] Date of Patent: * Jun. 1, 1993

[54] METHOD FOR BLEACHING AND ABRADING FABRICS

[75] Inventors: David J. Milora, Whitpain; David M. Shank, Lower Providence, both of Pa.; Peter A. Curato, Clementon, N.J.

[73] Assignee: Elf Atochem North America, Inc., Philadelphia, Pa.

[ * ] Notice: The portion of the term of this patent subsequent to May 19, 2009 has been disclaimed.

[21] Appl. No.: 594,763

[22] Filed: Oct. 9, 1990

Related U.S. Application Data

[63] Continuation of Ser. No. 290,779, Dec. 28, 1988, Pat. No. 5,114,426.

[51] Int. Cl.[5] ..... D06L 3/00

[52] U.S. Cl. ..... 8/102; 8/101; 8/107; 8/108.1; 8/116.1; 8/483; 8/111

[58] Field of Search ..... 8/108.1, 102, 110, 111, 8/159, 483

[56] References Cited

U.S. PATENT DOCUMENTS

| | | | |
|---|---|---|---|
| 3,986,824 | 10/1976 | Waibel et al. | 8/14 |
| 4,218,220 | 8/1980 | Kappler et al. | 8/102 |
| 4,460,490 | 7/1984 | Barford et al. | 252/92 |
| 4,570,229 | 2/1986 | Breen et al. | 364/476 |
| 4,575,887 | 3/1986 | Viramontes | 8/158 |
| 4,588,409 | 5/1986 | Sercus | 8/403 |
| 4,626,373 | 12/1986 | Finch et al. | 252/96 |
| 4,740,213 | 4/1988 | Ricci | 8/108 |
| 4,750,227 | 6/1988 | Hopkins et al. | 8/158 |
| 4,900,323 | 2/1990 | Dickson et al. | 8/111 |

FOREIGN PATENT DOCUMENTS

| | | |
|---|---|---|
| 3217188 | 10/1983 | Fed. Rep. of Germany . |
| 2517710 | 10/1983 | France . |
| 50-132269 | 10/1975 | Japan . |
| 2118463 | 11/1983 | United Kingdom . |

*Primary Examiner*—Prince Willis, Jr.
*Assistant Examiner*—John F. McNally
*Attorney, Agent, or Firm*—Panitch, Schwarze, Jacobs & Nadel

[57] ABSTRACT

Methods are provided for abrading dyed fabric to produce a stonewashed effect by tumbling the fabric with stones of a chemical composition that is soluble in wash or rinse liquid for the fabric, where the stones are of sufficient size and hardness to effect abrasion of the fabric without substantial mechanical disintegration of the stones and in a manner simulating the action of pumice stone. The chemical stonewashing composition may be a compacted powder, agglomerate, coagulate, or other integral mass or solid formed from an alkali or alkaline earth metal carbonate, bicarbonate, silicate, sulfate, borate, halide, hydroxide or hydrate or peroxyhydrate thereof, for example.

12 Claims, No Drawings

METHOD FOR BLEACHING AND ABRADING FABRICS

CROSS REFERENCE TO RELATED APPLICATIONS

This application is a continuation of our co-pending application Ser. No. 290,779, filed Dec. 28, 1988, now U.S. Pat. No. 5,114,426. This application is also related to our co-pending application Ser. No. 558, 980, which is a division of Ser. No. 290,779.

FIELD OF THE INVENTION

The present invention relates to chemical compositions useful for producing a stonewashed effect in fabrics, particularly indigo-dyed fabrics. More particularly, the invention relates to methods of producing a stonewashed effect in fabrics with compositions which avoid the disadvantages of presently used natural and synthetic stones.

BACKGROUND OF THE INVENTION

In the processing of denim goods and other fabrics, particularly articles of clothing, a common practice to produce a "stonewashed" or worn effect is to wash the articles with approximately an equal weight of natural or synthetic stones. Commerical washers used to achieve the best results are usually 125 lbs. to 800 lbs. capacity with an open-pocket design which effects maximum abrasion of the article by rolling of the article with the stones. This rolling or tumbling also causes piece-to-piece abrasion of the fabric, resulting in a stonewashed look due to the removal of a portion of the dyes, particularly indigo dyes, in the fabric. The degree of harshness of the abrasion or dye removal is controlled by load size, amount of stones used, water levels, and time of the wash or tumbling cycle.

The use of natural or synthetic stones in stonewashing processes has a number of deleterious effects on the washing equipment used, as well as on the fabrics being treated. Thus, the stones tend to finely abrade the inner metal shell of the washing equipment, rendering the equipment unsuitable for later washing of articles, such as sheets, towels, shirts, etc., which may be physically damaged, reducing the useable life of such articles. A further result of the abrasion process is that a sand or sludge formed by destruction of the stone during the wash process collects in sumps, filters, drainage areas and plumbing of the washing equipment, as well as in the fabric being treated. Another drawback is the propagation of dust generated from handling the stones in both storage and shipment prior to washing.

The most common abrasive material used for stonewashing is pumice stone. Other examples include ordinary rocks, sand, ceramic compositions, pieces of rubber tires, wood, rope, rigid polymeric foam forms, broken glass, etc. All of these materials must be removed from the washing equipment and the fabric after treatment, and many of them tend to disintegrate during the tumbling and abrasion process.

BRIEF SUMMARY OF THE INVENTION

According to the invention, compositions and methods are provided for abrading dyed fabric to produce a stonewashed effect by tumbling the fabric with integral masses (stones) of a chemical composition which is soluble in wash or rinse liquid for the fabric. The stones are of sufficient size and hardness to effect abrasion of the fabric without substantial disintegration of the pellets during tumbling, in order to simulate the action of pumice stone. Preferably, the stones are made of a chemical composition that is slowly soluble in water such that the stones will not substantially dissolve during tumbling in less than about three minutes. Examples of suitable chemicals for forming the stones include compacted powders of alkali or alkaline earth metal carbonates, bicarbonates, silicates, sulfates, halides, borates, hydroxides, and hydrated and peroxyhydrated forms thereof.

DETAILED DESCRIPTION OF THE PREFERRED EMBODIMENTS

Although stonewashing is most commonly practiced with indigo-dyed denim garments, stonewashing in general is applicable to virtually any fabric articles which are constructed wholly or in part of yarns or fibers which are pigmented or dyed in such a way as to exhibit visible variations in color or texture as a result of abrasion. As used herein, abrasion will be used in its broadest sense to include physical and/or chemical removal of portions of the fabric surface and/or the dyes therein by contact between the stones and the fabric.

In addition to 100 percent cotton or polyester/cotton blends, stonewashing may be applied to a variety of natural or synthetic fabrics. It has recently been reported that silks and rayons are being treated by stonewashing, and it has been indicated that crepe and satin are also possible candidates. The determining factors include sensitivity to chemical decolorizing agents and/or physical characteristics wherein the dye is applied to the surface of the fiber, leaving the core of the fiber undyed. In addition, certain fabrics have been developed for stonewashing wherein a non-affected dye is applied to the fiber (on the surface or into the core) and is subsequently covered with a dye that is sensitive to stonewashing, giving a multi-hued fabric after stonewashing treatment.

Articles to be stonewashed include garments, such as denim jeans and skirts, sweaters, hats, purses, and virtually any other objects constructed of fabric, whether wearing apparel or not. The present invention is applicable to any fabric article to which conventional stonewashing may be applied and has certain advantages which allow stonewashing which was difficult or impractical with prior stonewashing methods.

Stonewashing is normally practiced in water, but many applications call for abrasion of the garment in a wet, damp or dry condition, where garments are tumbled with abrasive stones without any liquid in the machine. The same process variations may be used according to the present invention. Further, while temperatures from about 110° F. to 160° F. are commonly used for stonewashing, virtually any temperature may be used depending upon fabric design, final effect desired, other fabric treatments used, and numerous other parameters.

According to the present invention, chemical "stones" are provided preferably by compacting powders, prills, crystals, granules or the like of the chemical into the form of tablets, pellets and/or other similar solids or integral masses, which may be tumbled with the fabric desired to be stonewashed. Alternatively, the chemical may be formed into stones as an agglomerate, a coagulate, cooled from a molten mass, or an exothermic mass (from heating a slurry to form a hydrated solid), for example. For ease in describing the present invention, the term "stones" will be understood to include a stonewashing chemical compound of the present invention which has been formed into an integral mass or solid by any suitable means to achieve the desired properties and purposes described herein.

The stones should be sufficiently hard and compacted to resist mechanical disintegration during tumbling with the fabric. Thus, premature disintegration of the stones will lessen the abrasive ability and the resulting stonewash effect. Preferably, the only significant disintegration of the stones should be by way of controlled dissolution of the stones by the liquid with which the fabric is tumbled, washed or rinsed.

Satisfactory stones made according to the present invention have been tested for hardness (breaking or disintegration strength) using a "RIMAC" spring tester obtained from Rinck-McIlwaine, Inc. Stones of the invention were placed between the plates of the spring tester, and force was applied until the stones broke into pieces. Satisfactory stones had a breaking strength in the range of about 8–120 psi, and preferably 10–50 psi.

The desired solubility of the chemical composition used to form the stones will depend upon the manner in which the stonewashing process is to be carried out and the desired effect on the fabric. Where the tumbling and abrasion process is to be carried out in a liquid, it is preferred that the stones will not substantially dissolve in the liquid in less than three minutes at the temperature of the liquid in which the fabric is tumbled. Obviously, higher liquid temperatures will result in faster dissolution of the stones, and adjustment of the tumbling liquid temperature can be used as a variable to control the degree of stonewashing with a given stone composition.

In processes where the stonewashing is not carried out in a liquid but merely with a dry or damp fabric, it may be desirable to form the stones of a chemical composition which is readily soluble in water or other liquid with which the fabric will eventually be washed and/or rinsed. In such a case, the stonewash composition of the invention may be removed from the fabric and tumbling equipment by simply introducing the wash or rinse liquid into the tumbling equipment after the stonewash process has been completed. The liquid will then dissolve the stones and will thereafter be drained from the equipment, leaving no particle residues in either the fabric or the equipment.

Alternatively, a chemical stonewash composition may be used which is substantially insoluble in the tumbling liquid, such as in cold water, but is moderately or highly soluble in a rinse liquid, such as hot water. The minimum solubility of the chemical stonewash composition may vary considerably depending upon its desired use, but generally the compositions should be totally soluble in the tumbling liquid or the rinse or wash liquid in less than the length of the tumbling, wash or rinse cycle desired, generally less than about thirty to about forty-five minutes, although longer cycles up to two hours or more are possible.

Suitable chemical compositions for use in forming the stonewashing stones of the present invention include alkakli or alkaline earth metal carbonates, bicarbonates, silicates, sulfates, borates, halides, hydroxides and the like, as well as their hydrates and peroxyhydrates. Hydrated materials are preferred because of their bridging and lump-forming characteristics which make them ideal for the formation of hard, disintegration-resistant stones. Examples of suitable chemical compositions include sodium carbonate, sodium chloride, sodium metasilicate and mixtures of these chemicals with other ingredients.

The particular chemical composition used for forming the stones will depend upon the type of abrasion or stonewashing effect desired. While some chemical compositions of the invention work by simple mechanical abrasion or scraping of the dye off the fabric surface, other stone compositions result in a chemical reaction to aid or effect the abrasion. For example, the chemical composition may contain strong oxidizers such as potassium permanganate ($KMnO_4$) or sodium hypochlorite (NaOCl), which gradually oxidize and destroy the color in specific areas where the stones touch the fabric. Other compositions, such as Example 4 below, cause swelling of the sizing or other chemical reactions, which allow the dye to be rubbed off as the fabric rubs against itself.

In general, it is preferred that the chemical stonewash composition be formed of a powder which is compacted under pressure to form a dense, dimensionally stable, solid form that is resistant to mechanical disintegration from tumbling and abrasion. The particular size and shape of the stones are not critial and may vary depending upon the particular stonewash effect desired. Conventional "stones" (i.e., pumice stones) range in size from the size of a table tennis ball to the size of a fist, but smaller or larger sizes are possible. Generally, the stones of the present invention should not be so small as to fit through the drain openings or screens in the tumbling or washing equipment to be used for the stonewashing, and stone diameters greater than about four inches are generally not advantageous. Satisfactory stones have been formed having a flat-faced or domed shape with a diameter of about one or one and one-quarter inches and a thickness of about three-quarters inch. Suitable tableting presses for forming stones of the present invention are available from the Sharples/Stokes Division of Pennwalt Corporation and are described, for example, in U.S. Pat. No. 4,570,229.

Where it is desired to tablet the chemical stonewash composition of the present invention, the composition may also include processing aids, binders and other processing additives known in the tableting art. Thus, since many compositions tend to stick to the die of the tableting punch, a die lubricant, such as calcium stearate, magnesium stearate, polyethyleneglycol polymers, and the like may be desirable to release the tablets from the tableting machine. Binders, such as benzoic acid fatty compounds, acrylates, polyvinyl alcohols and silicates, may also be used to increase the integrity or stability of the tablets.

In addition to the ingredients referred to above, the chemical stonewashing stones of the invention may also include other processing chemicals, such as bleaches, acids, fabric softeners, overbleaches, etc., depending upon the fabric treatments desired. Thus, bleaching or acid washing of the fabric may be carried out simultaneously with the stonewashing by incorporating the necessary chemicals in the chemical stonewash stones.

Other ingredients, which may be included in the chemical stonewash stones of the present invention, include dyes; enzymes; lubricants; dye fixatives; organic and polymeric anti-redeposition agents, such as sodium carboxymethyl cellulose, polyvinylpyrrolidones, and polyacrylates; anionic suspending agents; and organic chelating agents, such as ethylene diamine tetraacetic acid, nitrilotriacetic acid and salts thereof. Antiredeposition agents help to emulsify and carry away particles of dye, fabric, etc. which are abraded from the fabric and suspended in the rinse liquid, while chelating agents complex water hardness, heavy metal ions and some of the by-product components which may be released from the stone compositions. One skilled in the art may readily determine the type and amount of additional ingredients to be added to the chemical stonewash composition based on this disclosure and the fabric treatment desired.

The chemical compositions of the invention which have been formed into stones as described above result in desired fabric abrasion to produce a stonewash look, while avoiding physical damage to the wash equipment, eliminating drainage sludge, and essentially completely dissolving during the wash or rinse cycle so that little or no subsequent residues are left to be removed from the fabric or the equipment plumbing.

The invention will now be illustrated in further detail by reference to the following specifc, non-limiting examples. All composition parts are given in parts by weight.

EXAMPLES 1-4

Each of the four chemical compositions set forth below was compacted into 1" or 1¼" by ¾" tablets and used separately in the following stonewash process. Denim garments weighing a total of 12 lbs., and having been washed in an amylase enzyme bath to remove a substantial percentage of the sizing, were placed into a washer/extractor with a wash capacity of 75 lbs. 20 lbs. of tablets were added to the washer, and the door was closed and secured. Water at 90° F. was added to the washer to a high level, approximately 12" from the bottom of the wheel, and the garments/tablets load was tumbled with reversals every half minute for 20 minutes. The tablets were totally dissolved at the end of the 20 minutes and were washed away completely by the subsequent draining and rinsing. The finished garments exhibited a high degree of abrasion in the seams, cuffs, belt-loops, and other areas of rigidity and contact, giving an appearance of a garment that had been washed with pumice stones.

| | |
|---|---|
| Tablet Composition 1: | |
| Sodium carbonate (soda ash) | 100 parts |
| Calcium stearate (processing aid) | 2 parts |
| Tablet Composition 2: | |
| Sodium chloride | 95 parts |
| Calcium hypochlorite | 5 parts |
| Calcium stearate | 1 part |
| Tablet Composition 3: | |
| Sodium chloride | 50 parts |
| Protease and/or amylase enzymes | 50 parts |
| Tablet Composition 4: | |
| Sodium metasilicate | 60 parts |
| Sodium hydroxide | 40 parts |
| Calcium stearate | 1 part |

EXAMPLES 5 AND 6

Tablets were formed from the following compositions as in Examples 1-4, and denim garments were processed as described in the above Examples except that no free-standing water was present during the tumbling step. That is, the garments were tumbled in a dry or damp state, and rinse water was added after the tumbling to dissolve and wash away the tablet composition. The garments showed a good stonewashing effect from abrasion and dye oxidation.

| Tablet Composition 5 | |
|---|---|
| Sodium carbonate | 50 parts |
| Sodium chloride | 38 parts |
| Sodium hypoclorite solution (5 ¼% available chlorine) | 10 parts |
| Calcium stearate | 1 part |

In this composition, the water from the sodium hypoclorite solution forms a hydrate of the sodium carbonate so that a nearly dry mixture is fed to the tableting press.

| Tablet Composition 6: | |
|---|---|
| Sodium carbonate | 50 parts |
| Sodium chloride | 38 parts |
| Potassium permanganate | 1 part |
| Calcium stearate | 1 part |

Further tests have demonstrated similar effects with low water levels, around 2" and 3", and at lower water temperatures. Similar but less conspicuous effects are evident at higher temperatures, due primarily to the more rapid dissolution of the tablets, thus reducing the total physical abrasion demonstrated by the tablets of the invention. It is evident that compacted forms of other shapes and/or sizes or of lesser solubility will produce an enhanced abrasive effect by virtue of the longer time available to the fabric in the presence of the compacted tablets.

The present invention may be embodied in other specific forms without departing from the spirit or the essential attributes thereof and, accordingly, reference should be made to the appended claims, rather than to the foregoing specification as indicating the scope of the invention.

We claim:

1. A method for abrading and bleaching dyed fabric to produce a stonewashed effect comprising tumbling said fabric with stones of a chemical composition which is soluble in tumble, wash or rinse liquid for the fabric, said stones comprising integral masses of soluble ingredients and being of sufficient size and hardness to effect abrasion of said fabric without substantial mechanical disintegration of the stones during tumbling and essentially completely dissolving during the tumble, wash, or rinse cycle so that little or no subsequent residues are left to be removed from the fabric or the equipment plumbing, said stones comprising at least one bleaching compound.

2. A method according to claim 1 wherein the tumbling of the fabric and stones takes place in a liquid in which the stones are slowly soluble.

3. A method according to claim 2 wherein the stones will not substantially dissolve in the liquid in less than three minutes at the tumbling temperature.

4. A method according to claim 1 wherein the stones are tumbled with the fabric in a dry or slightly damp condition, and the stones are subsequently removed from the fabric by washing or rinsing of the fabric with a liquid in which the stones are soluble.

5. A method according to claim 1 wherein said liquid is water.

6. A method according to claim 1 wherein said stones are formed of a compacted powder.

7. A method according to claim 6, wherein said powder includes an adjunct selected from the group consisting of powder binders and die lubricants.

8. A method according to claim 1 wherein said composition comprises an alkali or alkaline earth metal compound selected from the group consisting of carbonates, bicarbonates, silicates, sulfates, borates, halides, hydroxides and the hydrates and peroxyhydrates thereof.

9. A method according to claim 8 wherein said composition also includes a chemical agent selected from the group consisting of acids, enzymes, dyes, polymeric antiredeposition agents, anionic suspending agents, organic chelating agents and fabric softeners.

10. A method according to claim 1 wherein said composition comprises at least one compound selected from the group consisting of sodium chloride, sodium carbonate, sodium metasilicate, calcium hypochlorite, sodium hypochlorite, sodium hydroxide, and postassium permanganate.

11. In a method for abrading and bleaching dyed fabric by tumbling the fabric in a liquid with stones for a period of time such that portions of the dye are removed from the fabric to produce a stonewashed look in the fabric, the improvement comprising said stones being formed of integral masses of a chemical composition which is slowly soluble in said liquid such that the stones will not substantially dissolve with tumbling in said liquid in less than three minutes, said chemical composition being sufficiently compacted to yield stones with a hardness which will resist mechanical disintegration during tumbling with the fabric and will effect such abrasion, said stones comprising at least one bleaching compound.

12. A method according to claim 11 wherein the liquid is water.

* * * * *